United States Patent [19]

Maldina

[11] 4,083,165

[45] Apr. 11, 1978

[54] STACKING AND TRANSFERRING DEVICE FOR CELLOWRAPPERS FOR CIGARETTE PACKS

[76] Inventor: Paolo Maldina, Via Genova 6, Bologna, Italy

[21] Appl. No.: 721,265

[22] Filed: Sep. 8, 1976

[30] Foreign Application Priority Data

Sep. 24, 1975 Italy ..... 2804 A/75

[51] Int. Cl.[2] ..... B65B 35/30

[52] U.S. Cl. ..... 53/164; 53/234; 214/6 BA

[58] Field of Search ..... 53/231, 232, 233, 234, 53/230, 162, 164; 214/6 BA, 8.5 A

[56] References Cited

U.S. PATENT DOCUMENTS

| | | | |
|---|---|---|---|
| 1,861,510 | 6/1932 | Rose | 53/234 X |
| 2,180,163 | 11/1939 | Milmoe et al. | 53/234 X |
| 2,379,655 | 7/1945 | Russell et al. | 53/234 |
| 2,443,952 | 6/1948 | Gilbert | 53/234 |
| 2,603,363 | 7/1952 | Bongiovanni | 214/6 BA |
| 2,609,646 | 9/1952 | Total | 53/230 |
| 3,422,970 | 1/1969 | Faerber | 214/8.5 A |
| 3,458,058 | 7/1969 | Faerber | 214/6 BA |
| 3,507,089 | 4/1970 | Mizelle et al. | 53/230 X |

FOREIGN PATENT DOCUMENTS

| | | | |
|---|---|---|---|
| 2,029,903 | 12/1971 | Germany | 53/234 |

*Primary Examiner*—Othell M. Simpson
*Assistant Examiner*—John Sipos
*Attorney, Agent, or Firm*—Spencer & Kaye

[57] ABSTRACT

Means for elevating cigarette packs from an endless conveyor and transferring such elevated packs to radial pockets of a star wheel rotated step where such packs are cellowrapped.

4 Claims, 3 Drawing Figures

STACKING AND TRANSFERRING DEVICE FOR CELLOWRAPPERS FOR CIGARETTE PACKS

This invention relates to machines for packing articles, in particular, cigarette packing machines. More specifically, the invention relates to cellowrappers which rewrap packs of cigarettes in a cellophane sheet or other similar material.

These machines, to automatically cellowrap cigarette packs or other similar packs at a uniform rate, commonly use a so-called star wheel consisting of a certain number of radial pockets which are angularly equidistant from each other. This wheel is jog-operated by an intermittent motion mechanism. During the dwell between each jog, the mouth of one of the radial pockets stops in alignment with the outlet of a coupling station to receive a cigarette pack together with a cellophane sheet which is engaged by the pack during transfer from the station outlet to the mouth of the pocket. The appropriate folding of the cellophane sheet round the pack will be completed in successive rotary steps of the star wheel. The packs to be cellowrapped must be fed in an orderly manner to the coupling station where each pack is engaged by transferring means, which lead it to the insertion into the relative star wheel pocket, after being orderly coupled to a cellophane sheet, located in position on the transfer path from the station to the pocket aligned with it.

The problem of the pack feed to the coupling station, and the one, concomitantly correlated with it, of the transfer of the pack, coupled to a relative sheet, in the mouth of the pocket which is stationary at the station outlet, is, generally speaking, solved, in the following two manners:

(a) By means of an endless conveyor, of the chain type with pushing paddles or crossbars, aligned with the stationary pocket and located under a feed hopper, from which the stacked packs are successively taken by the conveyor crossbars.

(b) By means of a feed belt, which delivers on a plunger head each successive leading pack of the row of packs conveyed by the belt itself. This plunger constitutes a first transferring means, which sequentially lifts each row leading pack, in order to form from the bottom a stack of packs of which the top one is sequentially transferred into the corresponding pocket of the star wheel, by a second plunger transferring means which is operatively aligned with the pocket and whose motion is in phase opposition in relation to the motion of the first plunger transferring means.

Both the above systems are inadequate when the speed or production rate of the cigarette packing machine exceeds certain values, considered so far as barrier values. For instance, in the first system as above, the descent by gravity of the packs from the feed hopper on the underlying chain conveyor gives rise to catching and transferring irregularities, when the cellowrapper operating rate exceeds a certain maximum safety value. In the second system, as above, there exist, under the same conditions, limitations to the rate itself due to the existence of idle times between the linked phases of transfer, and to the fact that the motions of the two plunger transferring means cannot obviously exceed the limit of the interference or crossing of the respective strokes. In fact, the lifting plunger cannot lift a pack if the overlying transferring means has not completed its return stroke after the insertion of a previous pack into the mouth of the pocket aligned at a given moment with it. Furthermore, the feeding belt cannot feed a new pack if the lifting plunger has not first completed its return or descent stroke. Finally, the cellophane sheet which must be coupled to a pack coming out of the coupling station obviously cannot be fed in position transverse to the pack insertion path if the transferring plunger has not first completed its return stroke, a condition which, as previously pointed out, conditions also the lifting of the pack to the top of the stack.

These conditions of the correlated intercalation of the motions of the lifting plunger and of the transferring plunger involve, in the respective alternate rectilinear motions, peaks of acceleration and relative forces of inertia, which, when the production rate exceeds certain limit values, are decidedly incompatible with the delicate nature of the packs to be cellowrapped, in the case in point, the cigarette packs.

An object of this invention is to increase beyond predetermined limits the production rate of a cellowrapping machine comprising a lifting plunger and a transferring plunger without exceeding the safety limits in the accelerations and in the forces of inertia, but by reducing the idle times of the intercalated operations and thereby increasing the number of operating cycles of the cellowrapping machine per unit of time.

Substantially, according to this invention, this purpose is achieved with a characteristic stacking-transferring device for cellowrapping machine, comprising stacking or lifting means and transferring or inserting means, in which the stacking means and the transferring means are susceptible of alternate motions intercalated between each other and are both provided with pack engaging means, capable of operatively interfering with the feed path of the packs arriving at the basis of the stacker, respectively with the path of the pack transfer from the top of the stack into the stacker, only in the respective active travels, while they are driven to accomplish the correlative return travels in conditions of substantial non-interference with the paths themselves, so that the lifting of a pack in the stack can be started by the stacking means, before the associated transferring means have completed their return travel, relating to the transfer of the previous pack, thus obtaining an increase of the cellowrapper rate of production, without exceeding critical values of acceleration in the alternating components of the device itself.

The foregoing and other objects and advantages will appear more fully hereinafter from a consideration of the detailed description which follows, taken together with the accompanying drawing wherein one embodiment of the invention is illustrated by way of example. It is to be expressly understood, however, that the drawing is for illustration purposes only and is not to be construed as defining the limits of the invention.

With reference to the drawings, in the illustrated embodiment, pack feed means at the bottom of the stacker is provided by the conveyor comprising the pair of endless belts 1 and 2, which sequentially transfer packs (received, for instance, from a feed hopper, not illustrated) to the stacker lifting means.

Figure 1:
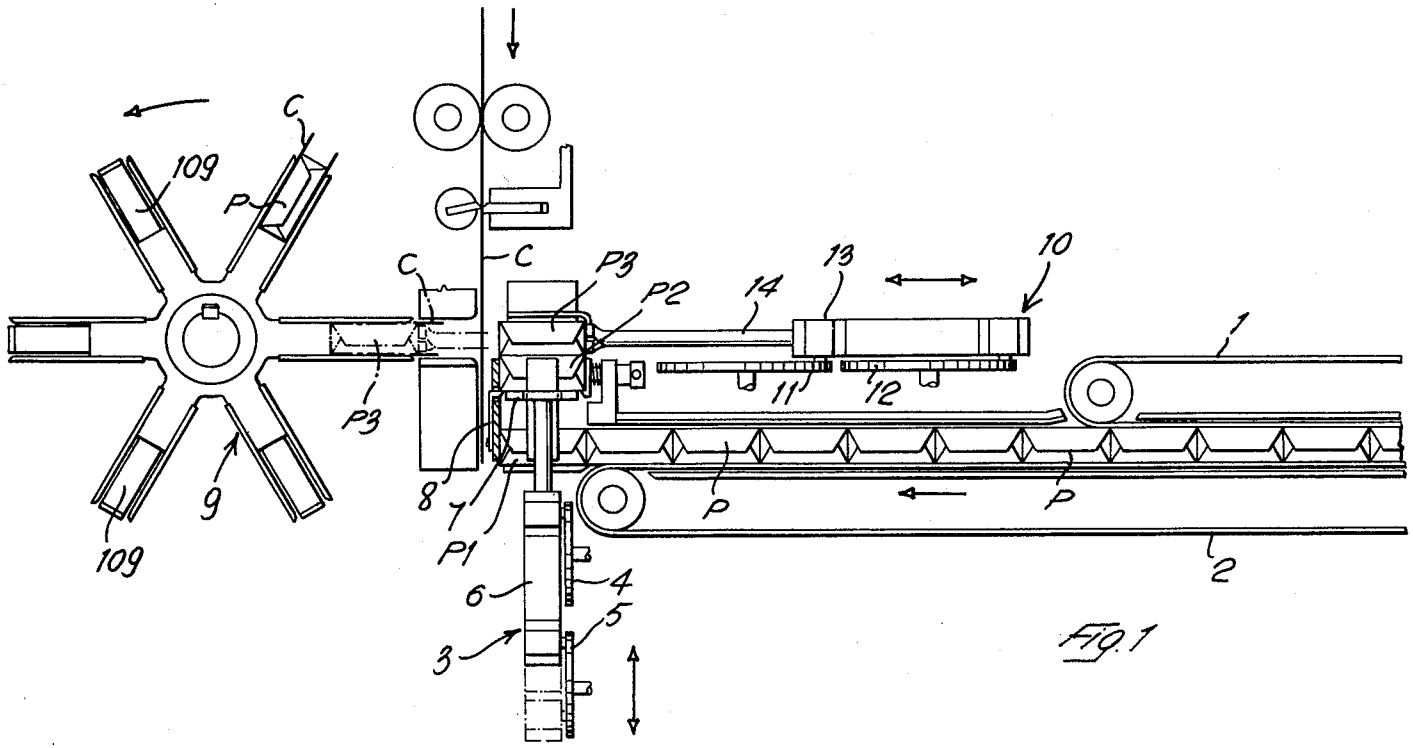
FIG. 1 is a schematic side elevation of a stacking-transferring device according to the present invention, fitted to a cigarette pack cellowrapping machine.

In the stacker, the sequential lifting of the packs is accomplished by a pair of lifting mechanisms 3, each of which consists substantially of an articulated parallelogram system, composed of two rotating crank discs 4 and 5 coupled to each other by means of connecting rod 6. This connecting rod carries a fork element 7 which always remains parallel to itself in its different positions of elevation since connecting rod 6 is continuously driven by cranks 4 and 5 in a motion of translation in closed circuit. Fork 7 extends horizontally in front of the delivery end of belt 2, and the vertical component of its total displacement is designed to have a value corresponding to twice the thickness of cigarette pack P to be cellowrapped. The horizontal component of the same displacement has such a value as to bring the fork 7, in certain intervals of its operating cycle, in conditions of non-interference with the pack discharged by belt 2 and, consequently, also with the stack P2, P3 (FIGS. 1 and 3) which moves up in the area of this pack P1. It should be noted that P1 indicates a package on the level of the feedline and P2, P3 indicate packages positioned progressively one package above the feedline.

Under operating conditions, at every working travel of the two forks 7 which operate in timed relationship, moving towards and away from each other, symmetrically from opposite sides in relation to the position of pack P1, a stack of two packs P2, P3 is formed of which the bottom pack P2 is supported by retaining means 8, which may comprise a spring retaining slide block, which is already known. The transfer of the top pack P3 of stack P2, P3 into pocket 109 of the star wheel 9 is operated by a pair of transferring mechanisms or devices 10, each of which is substantially an articulated parallelogram, consisting of two rotating crank disks 11, 12 and of a connecting rod 13 articulated to them. Each of the two connecting rods 13 has a plunger 14, the two plungers 14 being staggered in height between each other as to enable them to superimposed.

The joint motion of the two lifting mechanisms 3 occurs in phase opposition in relation to the joint motion of the two transferring mechanisms 10. This means that, when forks 7 are at the lower stroke end the plungers 14 are at the outer stroke end, that is, towards the mouth of pocket 109.

Figure 2:
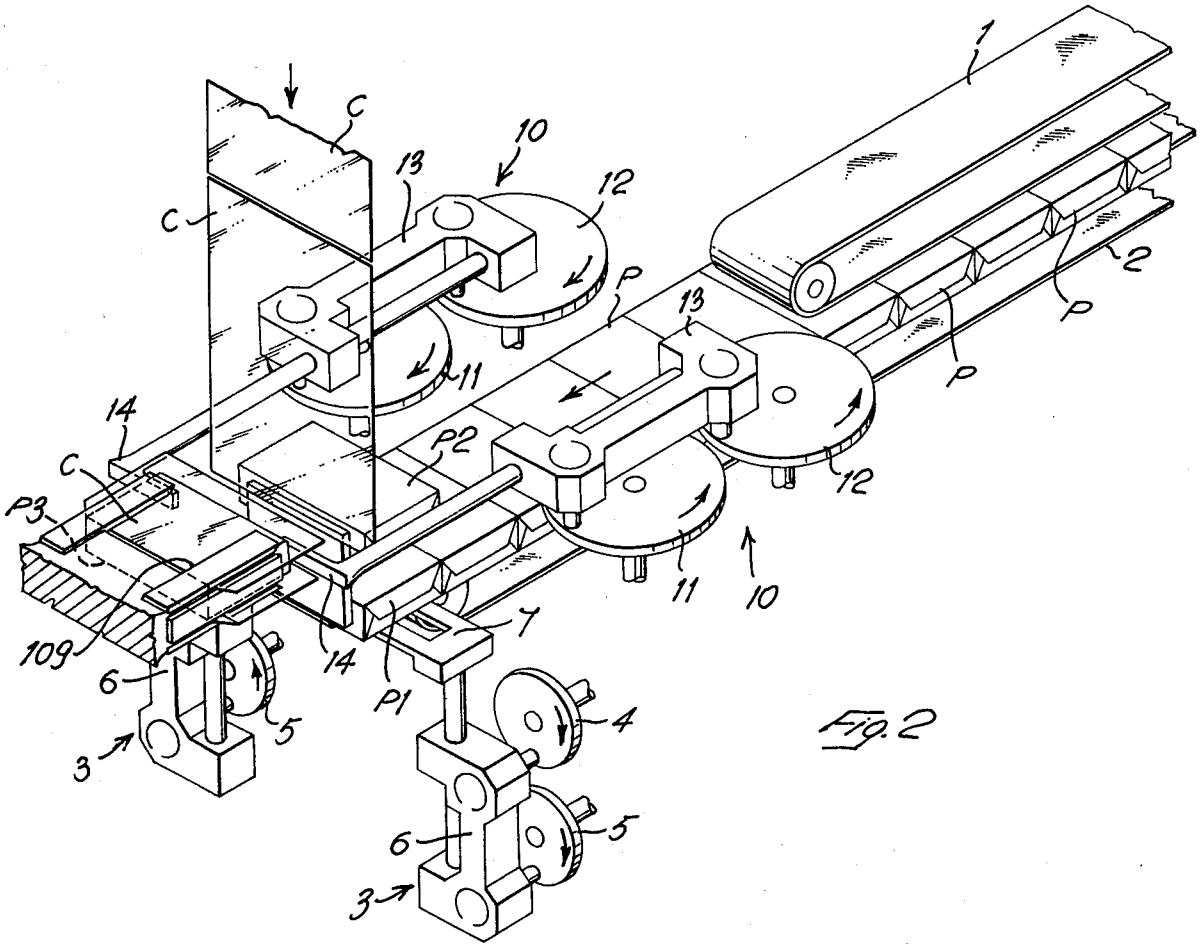
FIG. 2 is a perspective view of the device of FIG. 1 with the stacker at the beginning of its operating phase.
Figure 3:
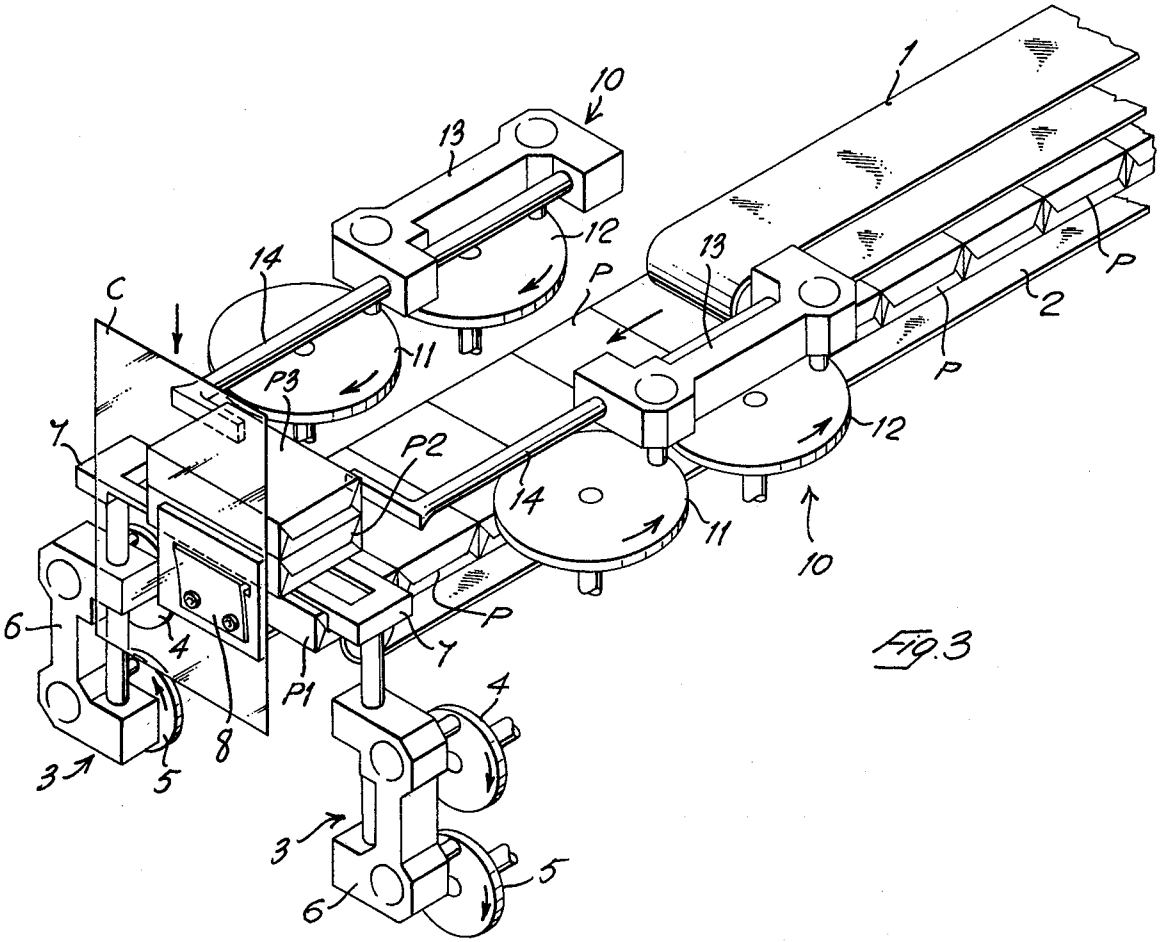
FIG. 3 is a perspective view similar to FIG. 2 with the stacker at the end of its stacking phase.

As it will be clearly understood from the comparative examination of FIGS. 2 and 3, forks 7 can lift a pack without waiting for plungers 14 to complete their return stroke. This is possible because the return stroke of plungers 14, similarly to that of forks 7, move outwardly away from one another or occurs in conditions of non-interference with the transfer path of pack P3 to pocket 109 whereby the upper pack P3 of the stack P2, P3 can be brought on this path by means of lifting devices 3 without waiting for pushers 14 to complete their return stroke since they do not interfere with this pack due to their spacing or interdistance. For the same reason, a cellophane sheet C can be fed in advance in the position in which pack P3 will engage it, dragging it in the transfer stroke to pocket 109.

Furthermore, because of the non-interference with forks 7 during their return stroke, belts 1 and 2 can feed a new pack P1 without having to wait for the forks to complete their return stroke. In fact, pack P1 passes under forks 7 which are reciprocally moved away from each other in their descent motion till the point where they do not interfere with the new fed pack.

Thus, according to the invention, the possibility of anticipating the presetting of a pack P3 in relation to the end of the return stroke of plungers 14 which have operated the transfer of the previous pack, and the correlative, intercalated anticipated feed of a new pack P1, in relation to the return stroke of forks 7, after the lifting of the previous pack P3, allow a considerable increase in the cellowrapper running rate, because of the substantial reduction of the machine idle times, as preannounced in the introductive part of this specification. It is however, evident that this increase involves acceleration peaks, in the reciprocating motion parts of the device, much lower than those which would be experienced, with the same increase, in a traditional stacking-transferring device, which does not use the said idle times for the anticipated pack feed. This is the point from which there derives one of the main advantages of the proposed device.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A transferring and stacking device for a cigarette pack cellowrap machine having conveying means for delivering packs one after another to be cellowrapped and a step by step rotatably driven star wheel with a plurality of radial pockets receiving successive cigarette packs each with an associated cellophane sheet, comprising:

means for retaining a plurality of cigarette packs one above the other in a stack, first and second transferring means continuously reciprocating each in phase opposition to the other and having a transverse component of displacement during reciprocation causing each transferring means to pass through the path of movement of the packs during the forward operating strokes and to prevent interference with the path of movement of the packs during the return strokes, said first transferring means removing cigarette packs one after another from said conveying means and delivering each such pack to the bottom of the stack held by said retaining means causing the uppermost pack of the stack to rise, said second transferring means removing the uppermost pack from the stack and delivering such packs each with a sheet of cellophane to successive pockets of said star wheel.

2. The stacking and transferring device in accordance with claim 1, and said first transferring means comprising:

a pair of stacking mechanisms operating in parallel timed relationship and symmetrically opposite from opposite sides of the stack in relation to the feed belt, said stacking mechanisms being provided with respective engaging means operating opposite to each other in pairs, with a displacement component in the direction of the stack and a displacement component transverse thereto, and the transverse component causing said respective engaging means to move along a path not interfering with said belt substantially during the complete return stroke of said means.

3. The stacking and transferring device in accordance with claim 2, and each of said stacking mechanisms being substantially an articulated parallelogram mechanism comprising:

two equal crank disks rotatably driven around superimposed axes, a connecting rod coupling said crank disks to each other and carrying one of said engaging means, each of said engaging means being a fork maintained in the horizontal while being moved vertically by said respective connecting rod, and the horizontal displacement component bringing said fork to engage and transfer a pack from said belt to the bottom of the stack during the forward operating stroke and moving said fork along a non-interfering path with said belt during the return stroke.

4. The stacking and transferring device in accordance with claim 3, and said second means comprising:

a pair of transferring elements, substantially operating in the horizontal, in correlation of functional parallelism with opposed symmetry in relation to the transfer path towards the wheel pocket, each of said elements being a pair of parallel-axis rotatable cranks and of a connecting rod coupling said cranks together, and each connecting rod having a plunger engaging and moving the uppermost pack of the stack along a path to said star wheel during the forward operating and laterally along a non-interfering path with the stack during each return stroke.

* * * * *